US011525196B2

(12) United States Patent
Quigley

(10) Patent No.: US 11,525,196 B2
(45) Date of Patent: Dec. 13, 2022

(54) WOVEN STRUCTURED FABRIC WITH CROSSING TWILL LINES

(71) Applicant: Voith Patent GmbH, Heidenheim (DE)

(72) Inventor: Scott D. Quigley, Bossier City, LA (US)

(73) Assignee: VOITH PATENT GMBH, Heidenheim (DE)

( * ) Notice: Subject to any disclaimer, the term of this patent is extended or adjusted under 35 U.S.C. 154(b) by 67 days.

(21) Appl. No.: 17/172,681

(22) Filed: Feb. 10, 2021

(65) Prior Publication Data

US 2022/0251741 A1 Aug. 11, 2022

(51) Int. Cl.
*D03D 13/00* (2006.01)
*D21F 1/10* (2006.01)

(52) U.S. Cl.
CPC ..... *D03D 13/002* (2013.01)

(58) Field of Classification Search
CPC .. D03D 13/002; D03D 13/004; D21F 1/0036; D21F 7/083; D21F 1/0045
See application file for complete search history.

(56) References Cited

U.S. PATENT DOCUMENTS 5,277,230 A * 1/1994 Sollars, Jr. ..... D03D 13/004 139/389
5,515,779 A * 5/1996 Danby ..... D21F 11/00 101/129
5,555,917 A * 9/1996 Quigley ..... D21F 1/0036 139/383 A
5,988,229 A * 11/1999 Quigley ..... D21F 1/0036 139/383 A
6,148,869 A * 11/2000 Quigley ..... D21F 1/0036 139/383 A
6,227,256 B1 * 5/2001 Quigley ..... D21F 1/0036 139/383 A
6,978,809 B2 * 12/2005 Quigley ..... D21F 1/0045 139/383 A
7,059,359 B2 * 6/2006 Quigley ..... D21F 1/0036 139/383 A
10,557,218 B2 * 2/2020 Nakai ..... D01H 1/241
10,688,956 B2 * 6/2020 Harabayashi ..... B60R 21/235
2004/0231745 A1 * 11/2004 Quigley ..... D21F 1/0036 139/383 A
2005/0067040 A1 * 3/2005 Quigley ..... D21F 1/0045 139/383 A (Continued)

*Primary Examiner* — Robert H Muromoto, Jr.
(74) *Attorney, Agent, or Firm* — Laurence A. Greenberg; Werner H. Stemer; Ralph E. Locher

(57) ABSTRACT

A woven fabric is used in a machine to produce a fiber web. The woven fabric has a machine direction, a cross machine direction, a paper side and a machine side. The paper side is formed by interwoven warp yarns and weft yarns. The paper side contains a plurality of twill lines, each twill line being formed by a plurality of neighboring flotations of warp yarns. The twill lines contain an MD vector component directed in the machine direction and a CD vector component directed in the cross machine direction. At least some twill lines are diagonal twill lines meaning that the CD vector component is unequal to zero. The plurality of diagonal twill lines contains first diagonal twill lines and second diagonal twill lines, the CD vector components of the first diagonal twill lines have an opposite sign to the CD vector components of the second diagonal twill lines.

20 Claims, 17 Drawing Sheets

(56) References Cited

U.S. PATENT DOCUMENTS

| | | | | |
|---|---|---|---|---|
| 2007/0068590 | A1* | 3/2007 | Quigley | D21F 1/0036 139/383 A |
| 2008/0169040 | A1* | 7/2008 | Barrett | D03D 13/004 139/383 A |
| 2014/0232165 | A1* | 8/2014 | Brielmann | D03D 1/0005 297/468 |
| 2018/0245247 | A1* | 8/2018 | Nakai | D03D 1/00 |
| 2018/0347114 | A1* | 12/2018 | Despault | D21F 7/12 |

* cited by examiner

WOVEN STRUCTURED FABRIC WITH CROSSING TWILL LINES

BACKGROUND OF THE INVENTION

Field of the Invention

The invention concerns a woven fabric for use in a machine to produce a fiber web, preferably a tissue fiber web, the woven fabric having a machine direction and a cross machine direction, as well as a paper side and a machine side. The paper side is formed by warp yarns and by weft yarns which warp yarns and weft yarns are interwoven with each other. The paper side contains a plurality of twill lines, each twill line being formed by a plurality of neighboring flotations of warp yarns. The twill lines contain an MD vector component directed in the machine direction of the woven fabric and a CD vector component directed in the cross machine direction of the woven fabric. At least some twill lines are diagonal twill lines meaning that the CD vector component of these twill lines is unequal to zero.

Such woven fabrics are already known in the market. One example of such a fabric 10' is shown in FIG. 1 which illustrates a view on of the paper side of the fabric 10'. As can be seen the paper side is formed by a plurality of warp yarns interwoven with a plurality of weft yarns. For the sake of clarity only three warp yarns are provided with reference signs, namely WA1', WA2' and WA3', and only five weft yarns are provided with reference signs, namely WE1', WE2', WE3', WE4' and WE5'. The fabric is flat woven which means that the warp yarns extend substantially, but not necessarily exactly, in machine direction MD of the woven fabric 10', whereas the weft yarns extend in cross machine direction CD of the woven fabric 10'. The woven fabric 10' is made endless by a not shown seam. In case the fabric is not flat woven but round woven the warp yarns would correspond to the weft yarns and vice versa.

In the shown example from the prior art each warp yarn forms serval flotations on the paper side of the woven fabric 10', wherein all flotations have the same length. One of these flotations is denominated with reference sign FL' in FIG. 1. This flotation FL' is formed by warp yarn WA2' which floats above the five weft yarns WE1'-WE5'. The neighboring warp yarns WA1' and WA3' form similar flotations on the paper side of the woven fabric 10' but with an offset. Thus, warp yarn WA1' floats only above weft yarns WE4' and WE5'—and three further weft yarns without reference sign—but not about weft yarns WE1', WE2' and WE3'. The offset results in that directly neighboring flotations of warp yarns together form a diagonal twill line TL' that extends substantially from the lower right side to the upper left side in FIG. 1. In fact, several such twill lines extend parallel to each other across the complete paper side of the woven fabric 10'. The distinctive diagonal twill lines are clearly separated from each other. In the present example between two neighboring twill lines there is some kind of plain weave structure, i.e. a woven structure which is free of any flotations.

The diagonal twill lines form a certain angle with the machine direction MD of the woven fabric 10', which angle is not zero. If the direction of the twill line TL' is described by an MD vector component MD-VC' extending in the machine direction MD of the woven fabric 10' and an CD vector component CD-VC' extending in the cross machine direction CD of the woven fabric 10', this means that the value of the CD vector component CD-VC' is unequal to zero. In the present example the CD vector component CD-VC' is directed against the cross machine direction CD of the woven fabric 10' so that it has a negative sign. The ratio of the MD vector component MD-VC' and the CD vector component CD-VC' is characteristic for the angle formed by the diagonal twill line TL' with the machine direction MD of the woven fabric 10'.

Such a woven fabric with diagonal twill lines on its paper side is conducive to sheet building, especially when the sheet is transferred to it with a rush speed differential. However, the strong diagonal twill lines make the fabric directional and difficult to guide on the paper machine.

BRIEF SUMMARY OF THE INVENTION

It is an object of the present invention to avoid or at least reduce this problem. In particular, the present invention aims to provide a woven fabric that is conducive to sheet building while at the same time it is easy to guide on the paper machine.

This object is achieved by a woven fabric according to the independent claim. Advantageous embodiments are the subject-matter of the dependent claims.

In particular the problem is solved by the generic woven fabric as described at the beginning wherein the plurality of diagonal twill lines consists of first diagonal twill lines and second diagonal twill lines. The CD vector components of the first diagonal twill lines have an opposite sign to the CD vector components of the second diagonal twill lines, and the sum of all CD vector components of the first diagonal twill lines is substantially balanced with the sum of all CD vector components of the second diagonal twill lines.

In this context the term "substantially balanced" means that the absolute value of the CD vector components of all first diagonal twill lines taken together corresponds to 80% to 120%, preferably to 90% to 110%, most preferably to 100%, of the absolute value of absolute value of the CD vector components of all second diagonal twill lines taken together.

Having diagonal twill lines extending in different directions on the paper side of the woven fabrics allows to guide the woven fabric easily on the paper machine.

Preferably, the woven fabric has only one layer. In such a case the warp and weft yarns that form the paper side at the same part also form the machine side of the woven fabric.

According to a preferred embodiment the number of the first diagonal twill lines substantially equals the number of the second diagonal twill lines. Furthermore, total length of all first diagonal twill lines can substantially equal the total length of all second diagonal twill lines.

The first diagonal twill lines preferably have all the same first CD vector component and the second diagonal twill lines preferably also have all the same second CD vector component. More preferably, the first CD vector component has the same absolute value than the second CD vector component. This can result in some kind of symmetry of the first diagonal twill lines and the second diagonal twill lines with respect to the machined direction of the woven fabric. This is especially true if additionally, all diagonal twill lines have the same MD vector component.

Preferably the diagonal twill lines are formed from neighboring flotations of warp yarns, wherein the flotations have a length of at least 3, more preferably of 5.

Some of the weft yarns can have a different cross section than other weft yarns. For example, the cross sections can vary as to their size and/or as to their shape. However, additionally or alternatively these weft yarns can differ from the other weft yarns with respect to their material and/or type. With "type" is meant here that the weft yarns are either monofilaments or multifilaments.

A very advantageous embodiment is characterized in that the weft yarns that are situated in the middle of any one of the flotations that define the diagonal twill lines have a cross section which is smaller than the cross sections of the remaining weft yarns that are not situated in the middle of any one of the flotations that define the diagonal twill lines. With such a configuration of different cross sections of the weft yarns, it is possible to keep the knuckle height of the flotations relatively low, i.e. to control the knuckle height of the flotations.

Preferably the warp yarns which form with their flotations the diagonal twill lines are interwoven with the weft yarns in a plain weave structure between two successive flotations. In other words, the corresponding sections of the warp yarns are interwoven with the weft yarns in such a way that the warp yarn goes continuously above and below directly neighboring weft yarns.

To achieve a more straight and less "stepped" twill line, it is advantageous if the flotations of the warp yarns which define the diagonal twill lines themselves form an angle unequal to 0° with the machine direction of the woven fabric, wherein the sign of the angle corresponds to the sign of the MD vector component of the diagonal twill line that is formed by the corresponding flotation.

In a preferred embodiment at least some of the diagonal twill lines extend straight from one side of the woven fabric to the opposite side thereof. Additionally, or alternatively at least some of the diagonal twill lines can end somewhere between opposite sides of the woven fabric. With "sides" of the fabric are meant the left and the right side of the fabric when looking into machine direction of the fabric.

Some diagonal twill lines can be broader than other diagonal twill lines. A broader twill line can be achieved for example by having two or more twill lines directly next to each other, i.e., without any separation e.g. a separation formed by a plain weave structure between them. Then these two or more twill lines can jointly form one broader twill line.

In some embodiments of the present invention the diagonal twill lines can be formed from neighboring flotations of warp yarns, wherein the flotations have a length of 7.

To obtain a desired level of contact area on the paper side of the fabric without removing excessive amounts of warp yarn material, it is proposed that the weft yarns that are situated in the middle of any one of the flotations that define the diagonal twill lines pass over at least one adjacent warp yarn on a first side of the corresponding flotation and pass under at least one adjacent warp yarn on a second side of the corresponding flotation. Furthermore, it is proposed that the weft yarns that are situated in the middle of any one of the flotations that define the diagonal twill lines each have one adjacent other weft yarn which other weft yarn passes over at least one adjacent warp yarn on the second side of the corresponding flotation and passes under at least one adjacent warp yarn on the first side of the corresponding flotation.

More preferably the weft yarns that are situated in the middle of any one of the flotations that define the diagonal twill lines pass over exactly one adjacent warp yarn on a first side of the corresponding flotation and pass under exactly two adjacent warp yarns on a second side of the corresponding flotation, wherein the weft yarns that are situated in the middle of any one of the flotations that define the diagonal twill lines each have one adjacent other weft yarn which other weft yarn passes over exactly one adjacent warp yarn on the second side of the corresponding flotation and passes under exactly two adjacent warp yarns on the first side of the corresponding flotation.

The weft yarns that are situated in the middle of any one of the flotations that define the diagonal twill lines and their corresponding adjacent other weft yarns can be equal to each other in view of at least one the following features: cross section, material, type, but may differ from other weft yarns in the woven fabric in view of that feature. Especially the weft yarns of the pair of weft yarns can have a smaller diameter than other weft yarns of the woven fabric.

Other features which are considered as characteristic for the invention are set forth in the appended claims.

Although the invention is illustrated and described herein as embodied in a woven structured fabric with crossing twill lines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
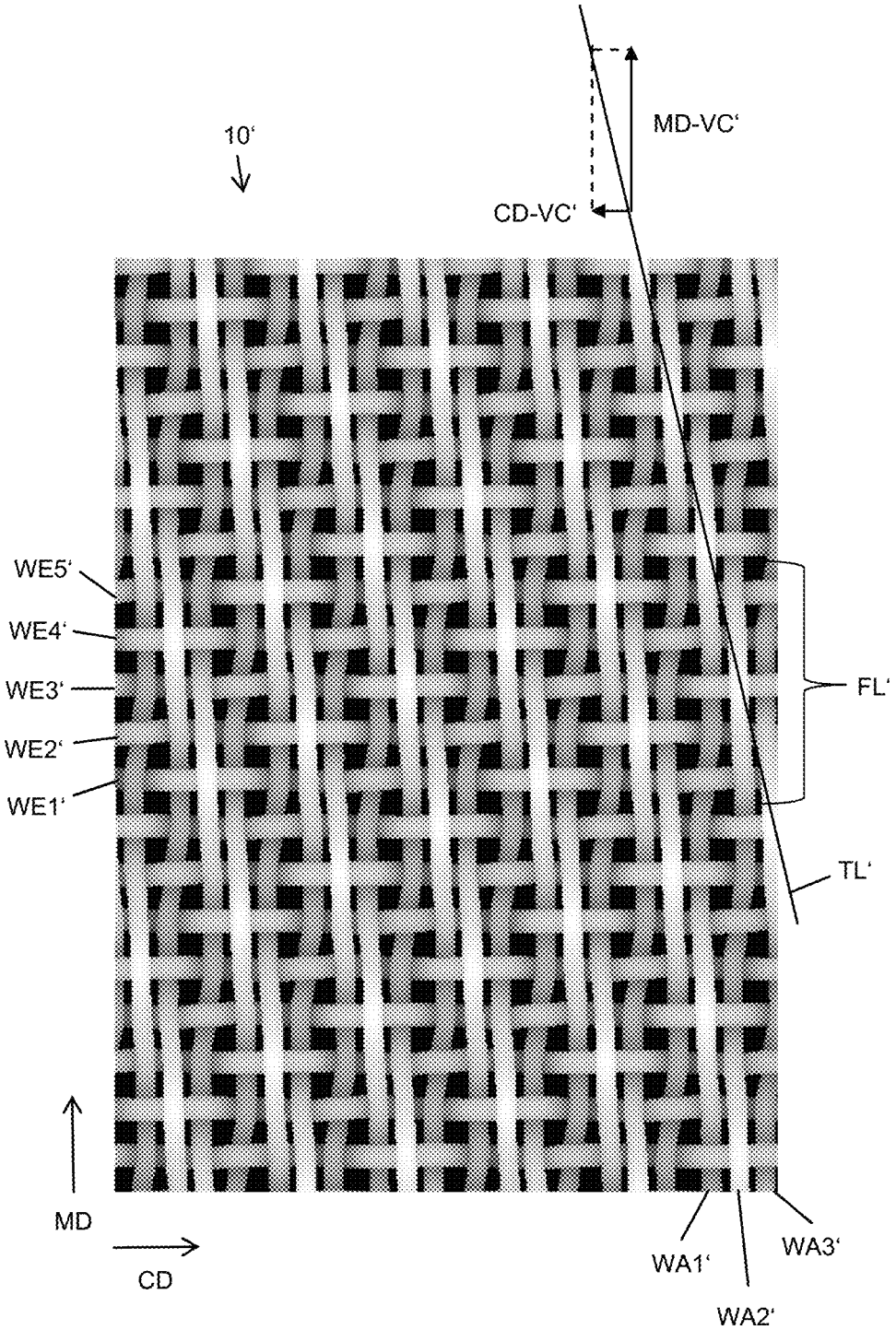
FIG. 1 (PRIOR ART)
FIG. 1 is an illustration showing a paper side of a fabric according to the prior art.
Figure 2:
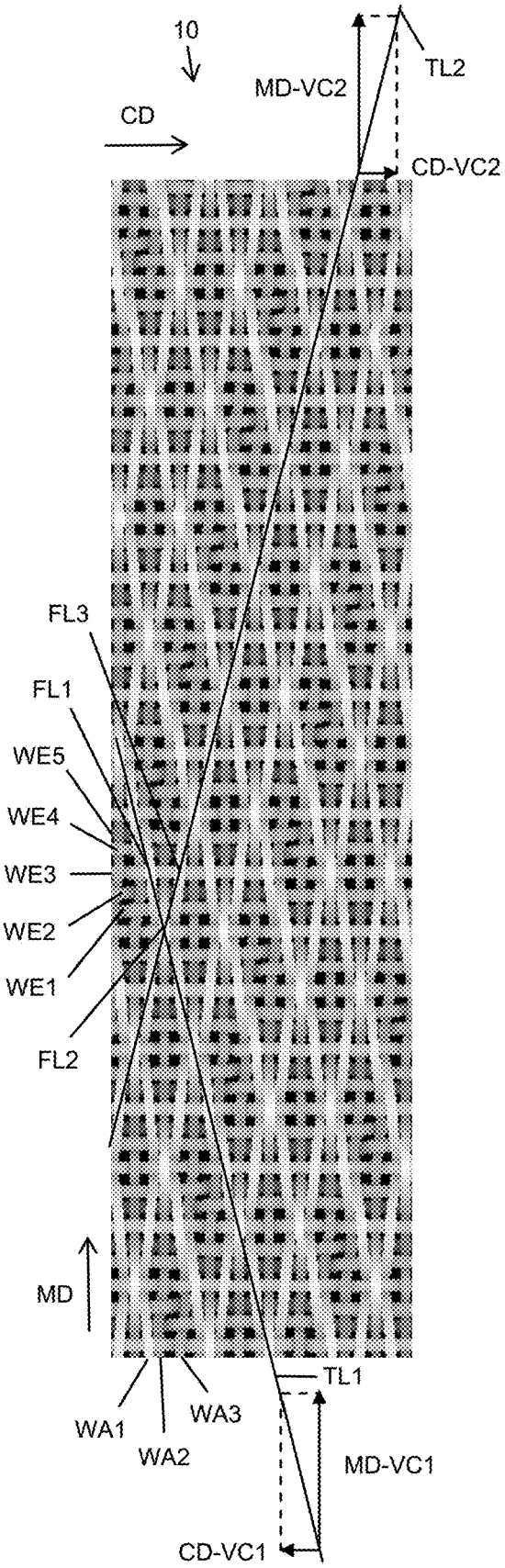
FIGS. 2 and 2A are illustrations showing a first embodiment of a woven fabric according to the invention and a modification of the first embodiment, respectively.

Referring now to the figures of the drawings in detail and first, particularly to FIG. 2 thereof, there is shown a first embodiment of the present invention which illustrates a view on the paper side of a portion of a woven fabric 10. The paper side is formed by a plurality of warp yarns interwoven with a plurality of weft yarns. Since the woven fabric 10 is a single layer fabric the same warp yarns and weft yarns also form the machine side of the woven fabric 10. For the sake of clarity only three warp yarns are provided with reference signs, namely WA1, WA2 and WA3, and only five weft yarns are provided with reference signs, namely WE1, WE2, WE3, WE4 and WE5. The fabric is flat woven which means that the warp yarns extend substantially, but not all necessarily exactly, in machine direction MD of the woven fabric 10, whereas the weft yarns extend in cross machine direction CD of the woven fabric 10. The woven fabric 10 is made endless by a not shown seam. In case the fabric is not flat woven but round woven the warp yarns would correspond to the weft yarns and vice versa.

Each warp yarn forms serval flotations on the paper side of the woven fabric 10, wherein all flotations have the same length in the shown embodiment. One of these flotations is denominated with reference sign FL1 in FIG. 2. The flotation FL1 is formed by warp yarn WA1 which floats above the five weft yarns WE1-WE5. Another of these flotations is denominated with reference sign FL3 which is formed by warp yarn WA3 which also floats above the five weft yarns WE1-WE5. Yet another of these flotations is denominated with reference sign FL2 which is formed by warp yarn WA2 floating weft yarns WE1 and WE2 and three other weft yarns but not weft yarns WE3, WE4 or WE5. Flotation FL2 is directly neighboring both, flotation FL1 and flotation FL3, wherein the flotations FL1 and FL3 are not neighbored to each other.

All the flotations together form a plurality of twill lines on the paper side of the woven fabric 10. In FIG. 2 some twill lines extend in a direction which—roughly speaking—extends from the lower right side to the upper left side. These twill lines will be referred to as "first diagonal twill lines" in the following. The remaining twill lines extend—again roughly speaking—in a direction from the lower left side to the upper right side in FIG. 2. These twill lines will be referred to as "second diagonal twill lines" in the following. The first diagonal twill lines are all parallel to each other and spaced apart from each other by the same distance. Similarly, the second diagonal twill lines are parallel to each other and spaced apart from each other. However, the distance between the second twill lines varies in this exemplary embodiment. To be more precise, there are two different distances between parallel second twill lines, wherein the two different distances alternate.

Thus, the first diagonal twill lines and the second diagonal twill lines cross each other in a substantially regular pattern. The woven fabric 10 contains areas with a plain weave structure between the intersecting first and second diagonal twill lines. These areas define pockets on the paper side of the woven fabric 10, whereas the first and second diagonal twill lines define elevations on the paper side of the woven fabric 10. Thus, the woven fabric 10 is structured on its paper side wherein the structure is preferably adapted to impart a good visible pattern on a final fiber web, in particular final tissue fiber web, that is formed or transported in a wet form on the paper side of the woven fabric 10.

For the sake of clarity only one first diagonal twill line is denominated with reference sign TL1 in FIG. 2, and only one second diagonal twill line is denominated with reference sign TL2 in FIG. 2. The flotation FL1 contributes to the definition of the first diagonal twill line TL1, the flotation FL3 contributes to the definition of the second diagonal twill line TL2, and the flotation FL2 contributes to the definition of both, the first and second diagonal twill lines TL1 and TL2. In other words, the flotation FL2 is situated at the crossing point of the two diagonal twill lines TL1 and TL2.

The first diagonal twill line TL1 forms a first angle with the machine direction MD of the woven fabric 10, which angle is not zero. The direction of the first diagonal twill line TL1 can be described by a first MD vector component MD-VC1 extending in the machine direction MD of the woven fabric 10 and a first CD vector component CD-VC1 extending in the cross machine direction CD of the woven fabric 10. The value of the first CD vector component CD-VC1 is unequal to zero.

The second diagonal twill line TL2 forms a second angle with the machine direction MD of the woven fabric 10, which angle is not zero. The direction of the second diagonal twill line TL2 can be described by a second MD vector component MD-VC2 extending in the machine direction MD of the woven fabric 10 and a second CD vector component CD-VC2 extending in the cross machine direction CD of the woven fabric 10. The value of the second CD vector component CD-VC2 is unequal to zero.

Like in the present embodiment it is preferable that the first MD vector component MD-VC1 is the same as the second MD vector component MD-VC2 in view of its direction and magnitude, whereas the first CD vector component CD-VC1 only corresponds to the second CD vector component CD-VC2 in terms of its magnitude but not in terms of its direction. In fact, the first CD vector component CD-VC1 is directed to the left in FIG. 2 and, thus, against the cross machine direction CD of the woven fabric 10, whereas the second CD vector component CD-VC2 is directed to the right in FIG. 2 and, thus, in cross machine direction CD of the woven fabric 10. In other words, the first CD vector component CD-VC1 and the second CD vector component CD-VC2 have the same absolute value but opposite signs. Here the sign of the first CD vector component CD-VC1 is negative while the sign of the second CD vector component CD-VC2 is positive.

The ratio of the first MD vector component MD-VC1 and the first CD vector component CD-VC1 is characteristic for the first angle formed by the first diagonal twill line TL1 with the machine direction MD of the woven fabric 10. The ratio of the second MD vector component MD-VC1 and the second CD vector component CD-VC2 is characteristic for the second angle formed by the second diagonal twill line TL2 with the machine direction MD of the woven fabric 10. The first angle and the second angle also have the same magnitude but opposite signs.

Such a woven fabric with corresponding first diagonal twill lines TL1 and second diagonal twill lines TL2 on its paper side is not only conducive to sheet building, especially when the sheet is transferred to it with a rush speed differential but can also be easily guided on the paper machine.

Notably, the flotations FL1 and FL3 themselves are inclined with respect to the machine direction MD of the woven fabric 10, wherein their inclination substantially corresponds to the inclination of the first diagonal twill line TL1 and the second diagonal twill line TL2 with the machine direction, respectively. In contrast to that, the flotation FL2 at the crossing point of the two diagonal twill lines TL1 and TL2 extends substantially parallel to the machine direction MD of the woven fabric 10.

Figure 2A:
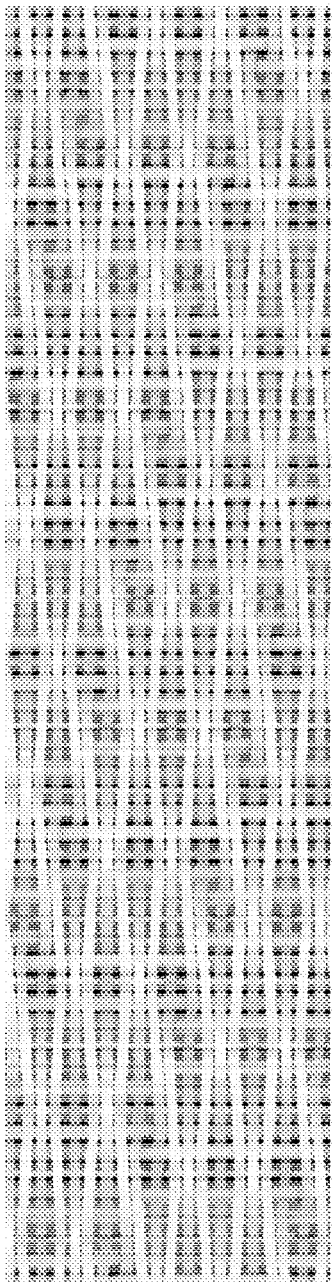

FIG. 2A shows a modification of the first embodiment from FIG. 2. The portion of a woven fabric in FIG. 2A has substantially the same weaving pattern as the weaving pattern of the portion of the woven fabric 10 shown in FIG. 2. However, in FIG. 2*a* weft yarns with different diameter are applied. To be more precise, the weft yarns that pass under the middle of any of the flotations of the warp yarns on the paper side of the woven fabric have a smaller diameter than the remaining weft yarns that do not pass under the middle of any of the flotations of the warp yarns on the paper side of the woven fabric. This results in that the knuckles formed by the warp yarn flotations on the paper side are not as high as in the first embodiment according to FIG. 2. Thus, the pattern imparted in the final fiber web can be positively influenced.

In the modification according to FIG. 2A all warp yarn flotations on the paper side of the woven fabric have the same length because they all pass over five consecutive weft yarns. Furthermore, two consecutive weft yarns having a larger diameter are followed by one weft yarn having a smaller diameter and so on.

Figure 3:
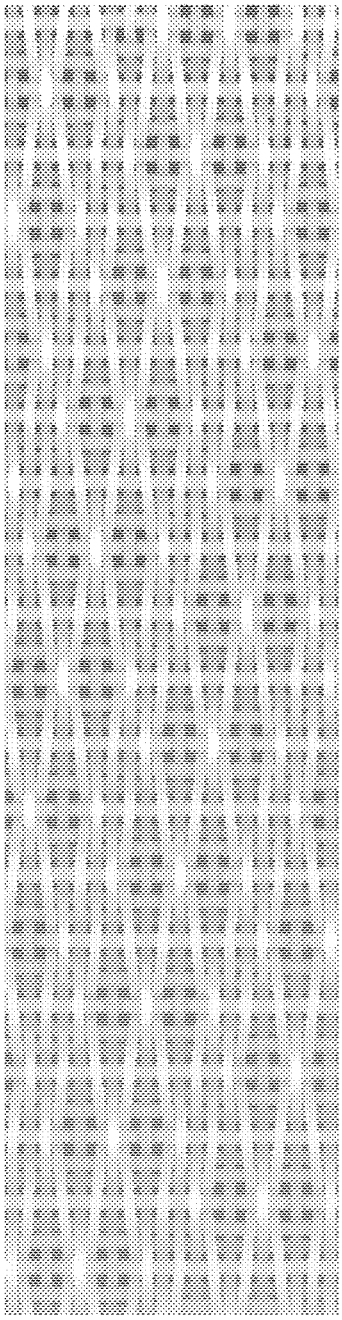
FIGS. 3 and 3A are illustrations showing a second embodiment of the woven fabric similar to the first embodiment, and a modification of the second embodiment, respectively.
Figure 3A:
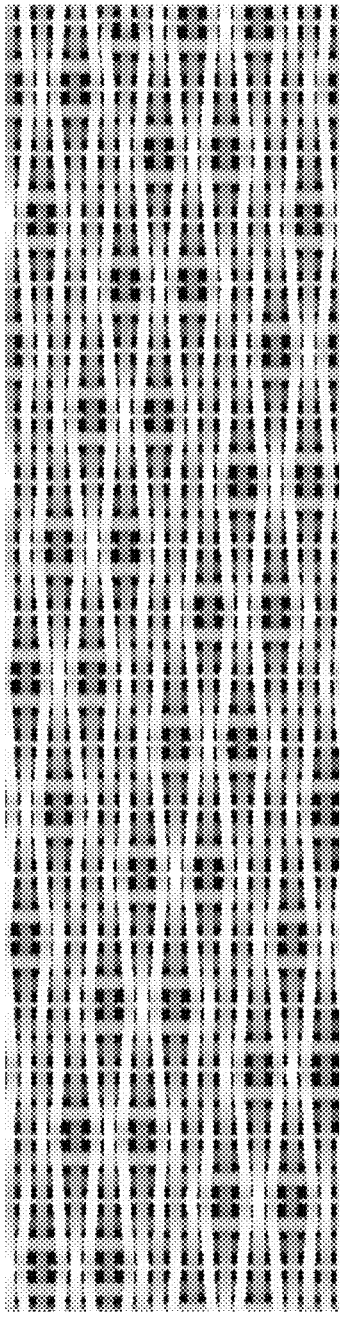

FIGS. 3 and 3*a* show a second embodiment of the present invention, similar to the first embodiment, and a modification of the second embodiment, respectively. In the following only the differences as to the first embodiment and its modification will be explained. For the rest, reference is made to the above description.

The second embodiment according to FIG. 3 and its modification according to FIG. 3A substantially only differ from the first embodiment according to FIG. 2 and its modification according to FIG. 2A, respectively, in that some second twill lines are broader then the remaining second twill lines and also than the first twill lines. In fact, broad second twill lines alternate with small second twill lines. The width of the twill lines can be adjusted by the number of warp yarn flotations that contribute to their definition.

Figure 4:
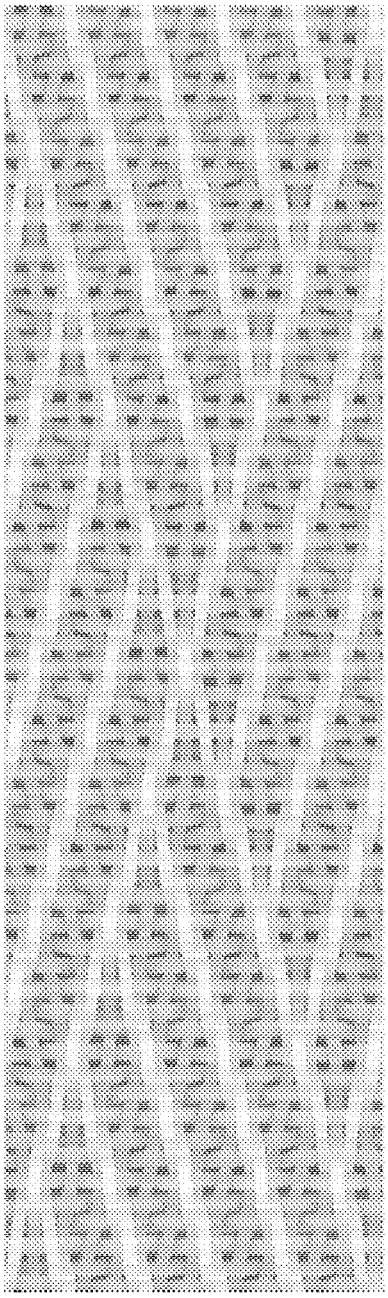
FIGS. 4 and 4A show a third embodiment of the woven fabric and a modification of the third embodiment, respectively.
Figure 4A:
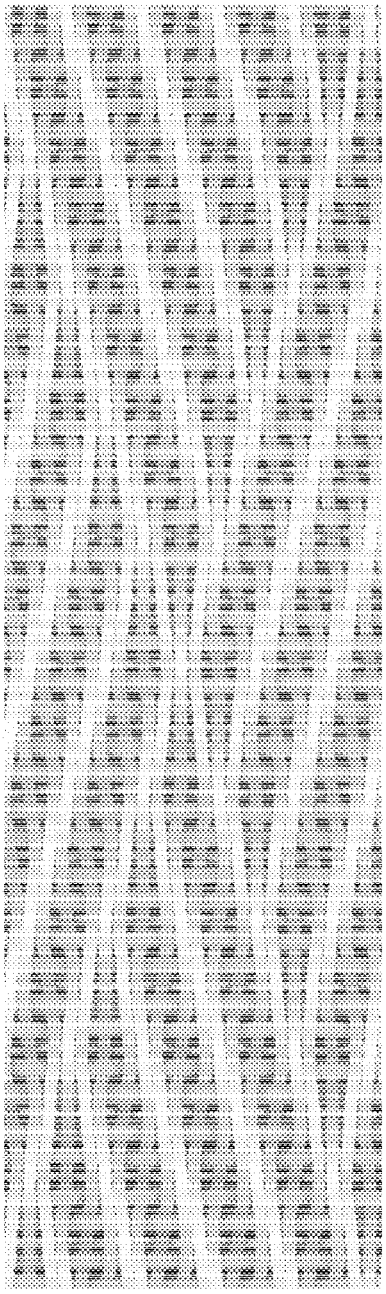

FIGS. 4 and 4A show a third embodiment of the present invention and a corresponding modification thereof, respectively. In the following only the differences as to the first embodiment and its modification will be explained. For the rest, reference is made to the above description.

The third embodiment according to FIG. 4 and its modification according to FIG. 4*a* substantially differ from the first embodiment according to FIG. 2 and its modification according to FIG. 2A, respectively, in that some first twill lines end when reaching a second twill line and vice versa. In the portion of the woven fabric shown in FIG. 4 only one first diagonal twill line really crosses one second diagonal twill lines. All other first and second diagonal twill lines end at another diagonal twill line in this shown portion. The two crossing diagonal twill lines divide the shown portion of the woven fabric into four sections, two of them having first diagonal twill lines extending parallel to each other, and two of them having second diagonal twill lines extending parallel to each other.

Figure 6:
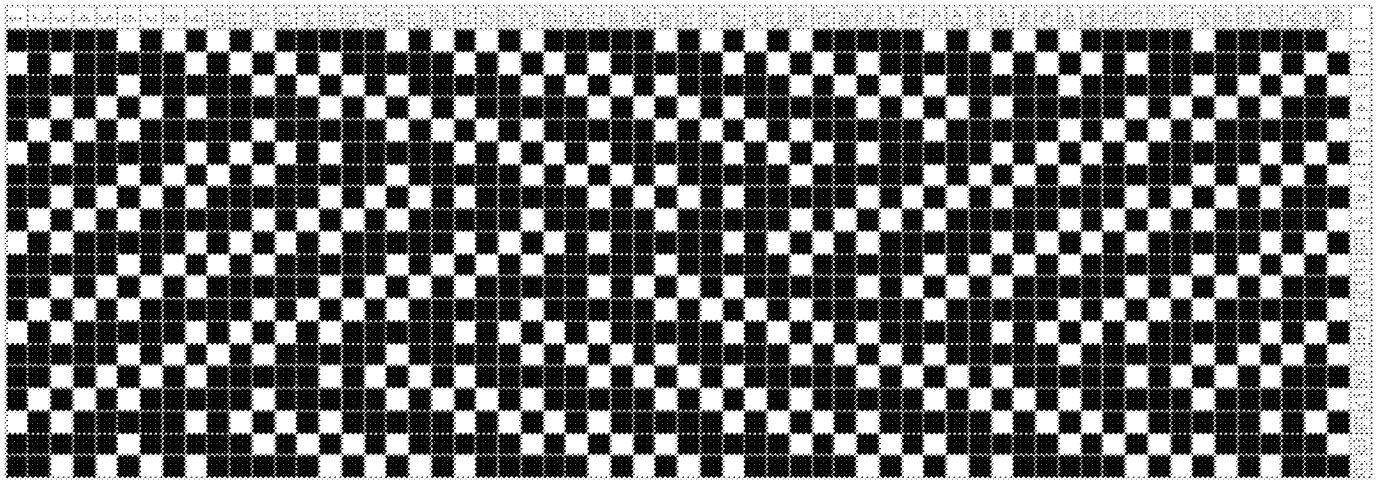
FIGS. 6 and 6A show a weaving pattern and a weaving card of the third embodiment of the present invention, respectively.
Figure 6A:
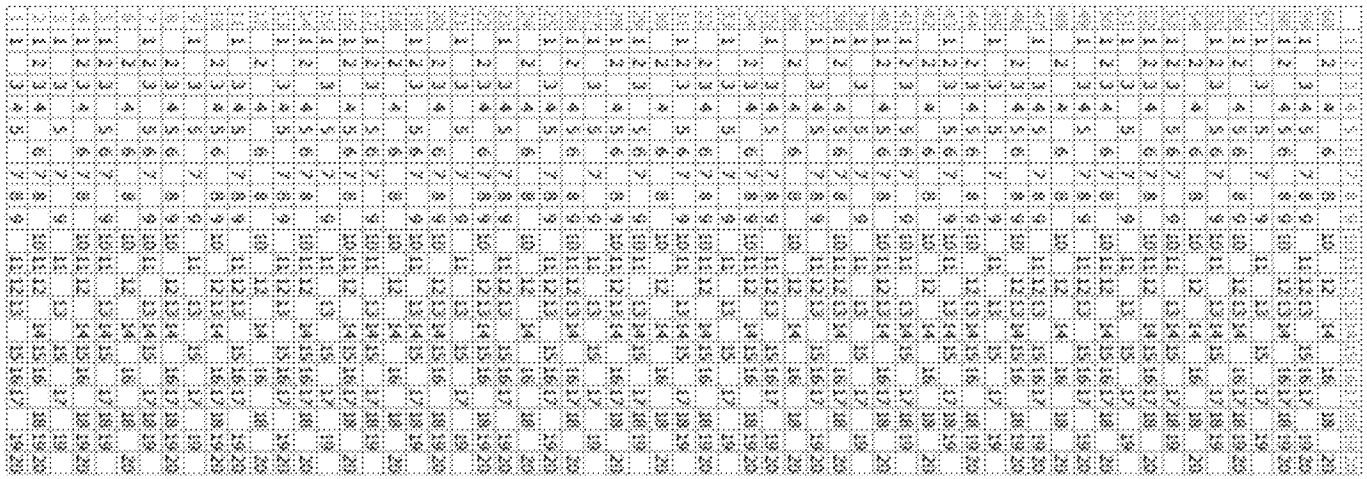
Figure 7A:
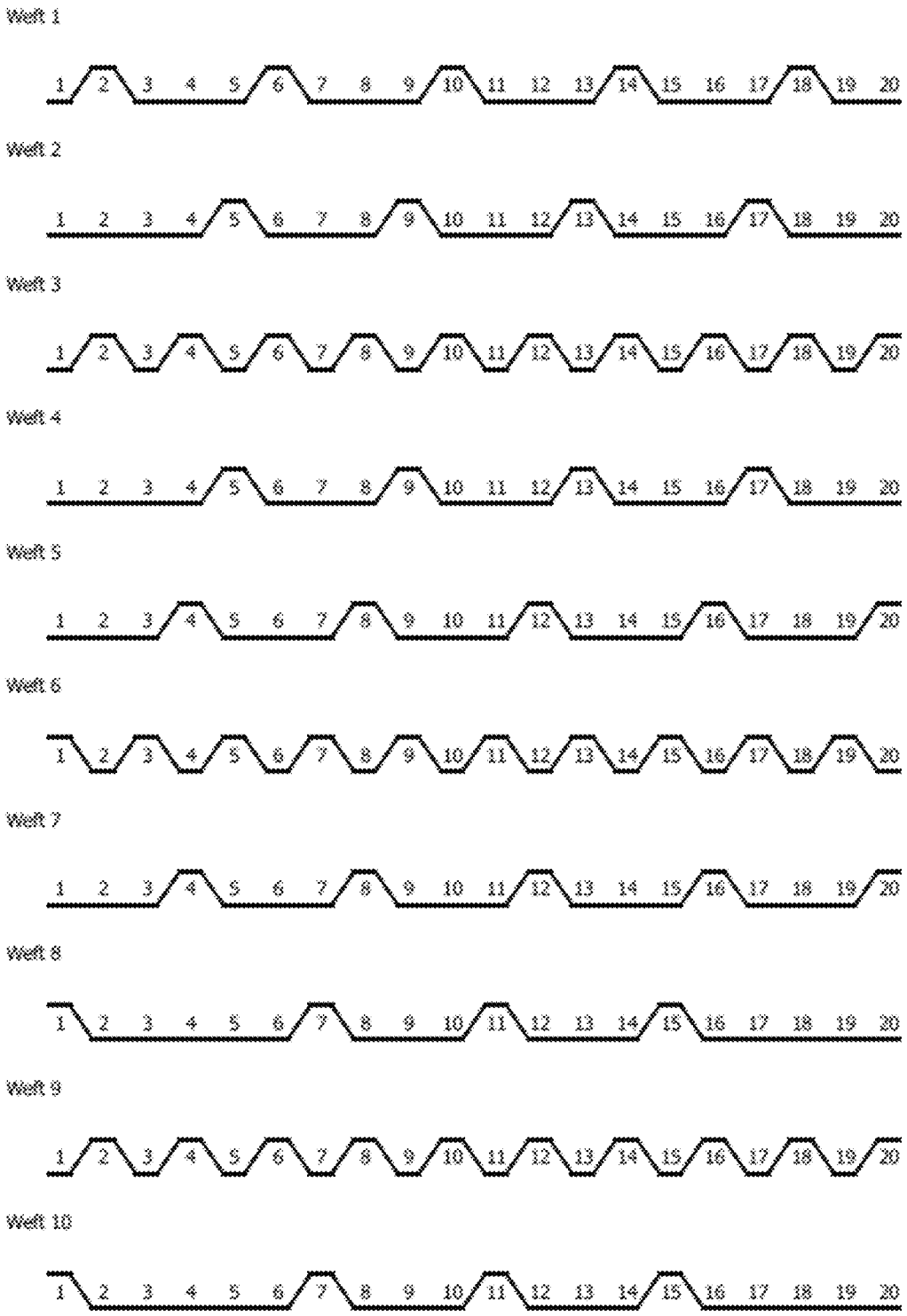
FIGS. 7A-7F show weft yarn paths of the third embodiment.
Figure 7B:
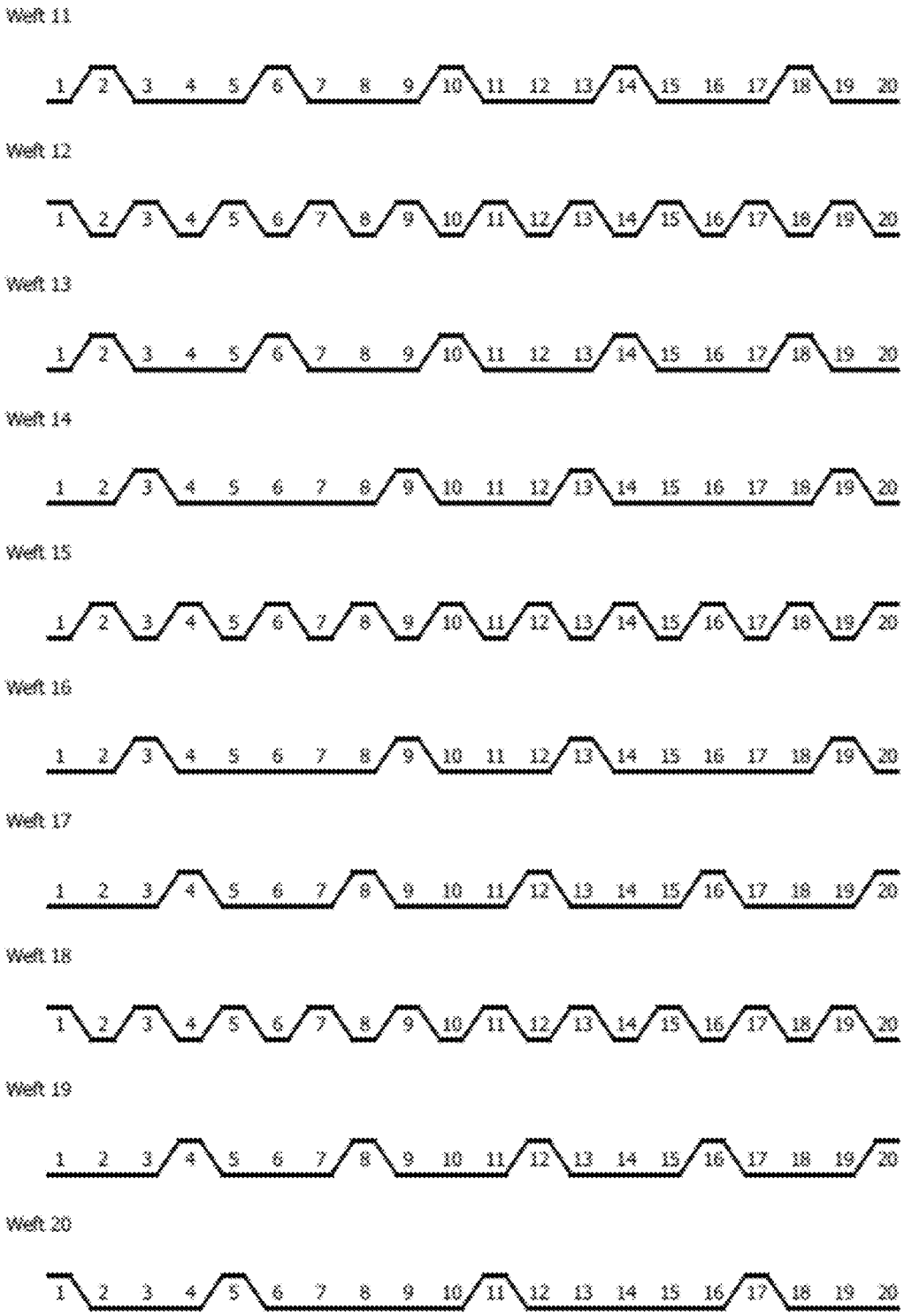
Figure 7C:
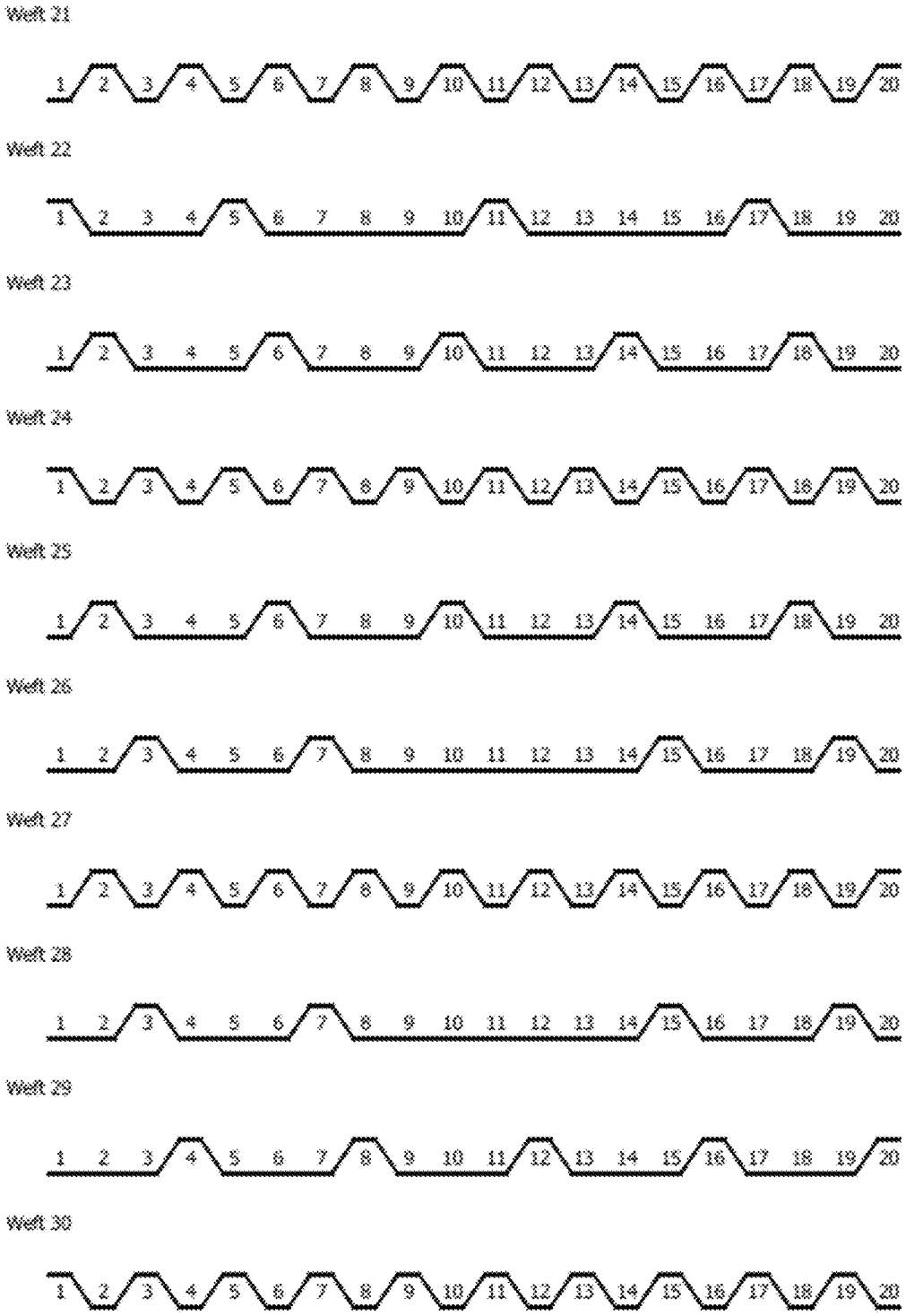
Figure 7D:
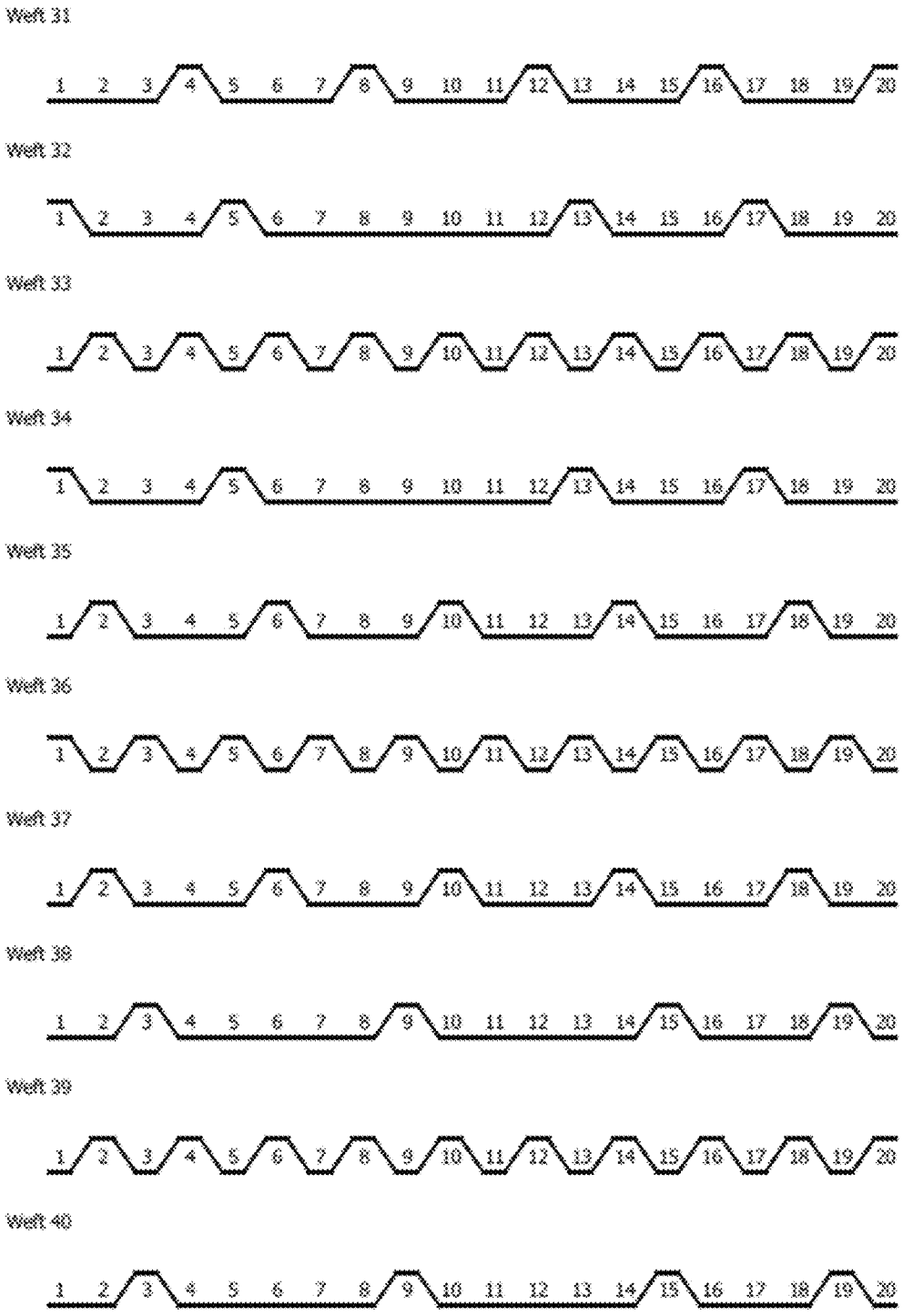
Figure 7E:
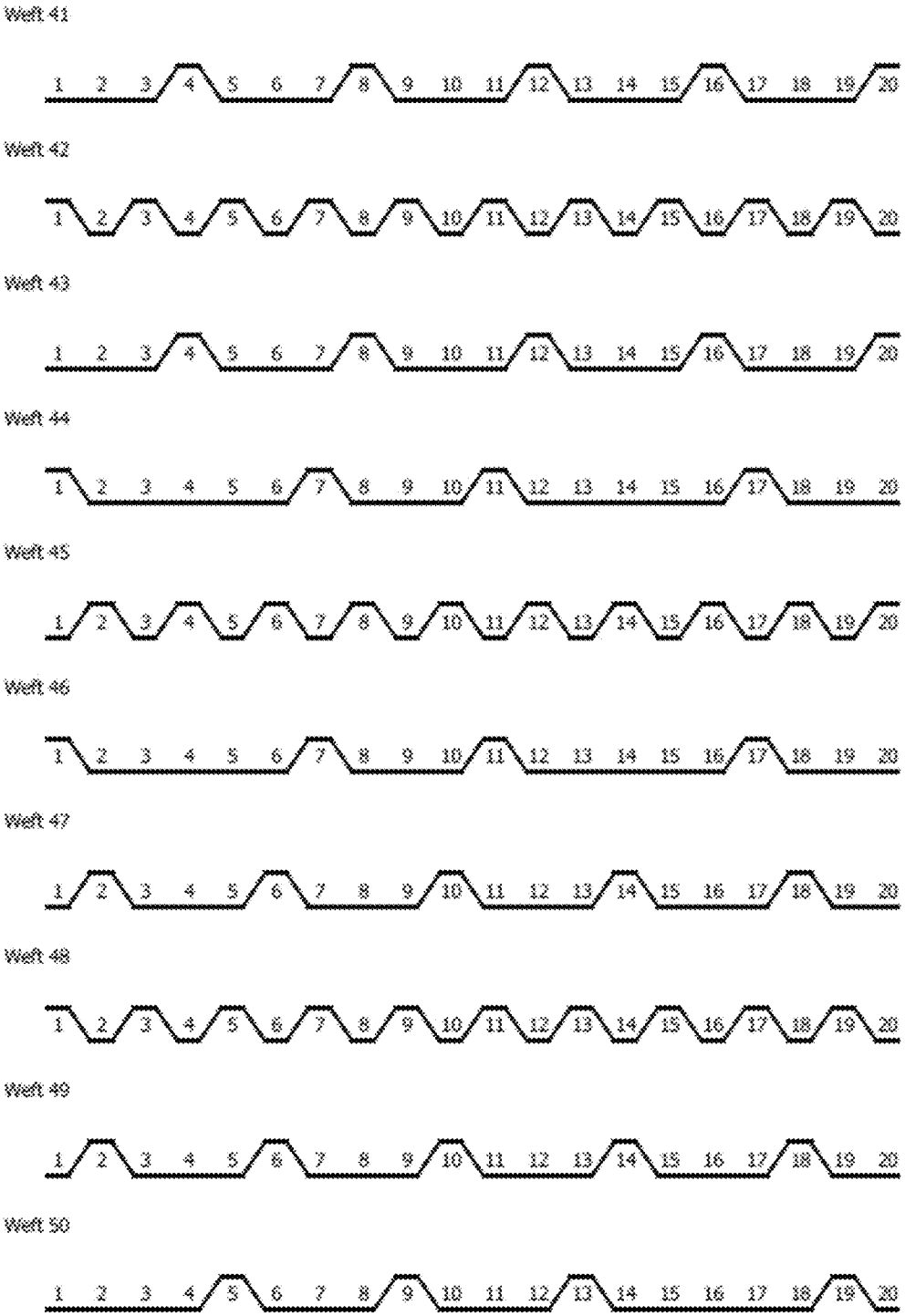
Figure 7F:
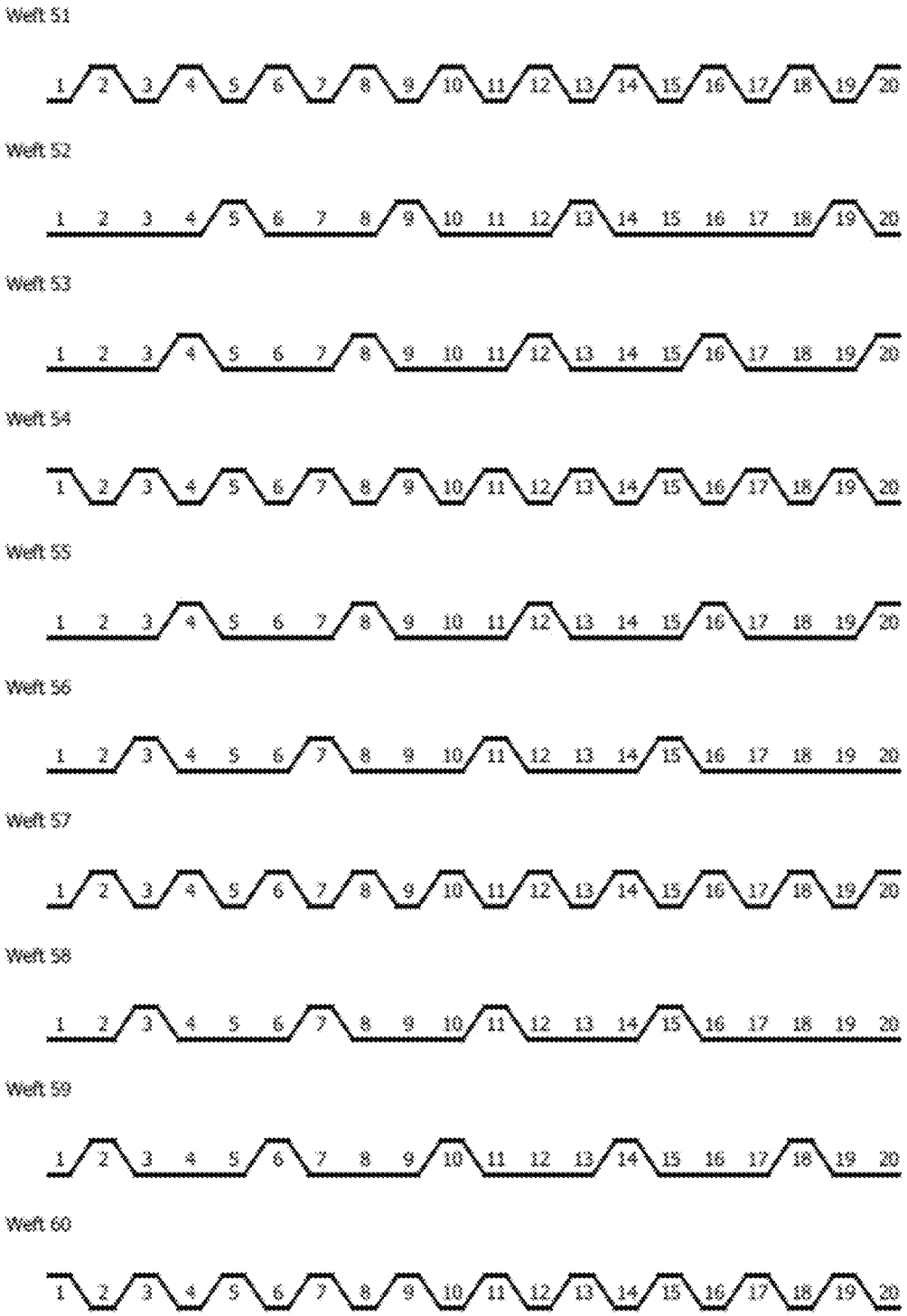
Figure 8A:
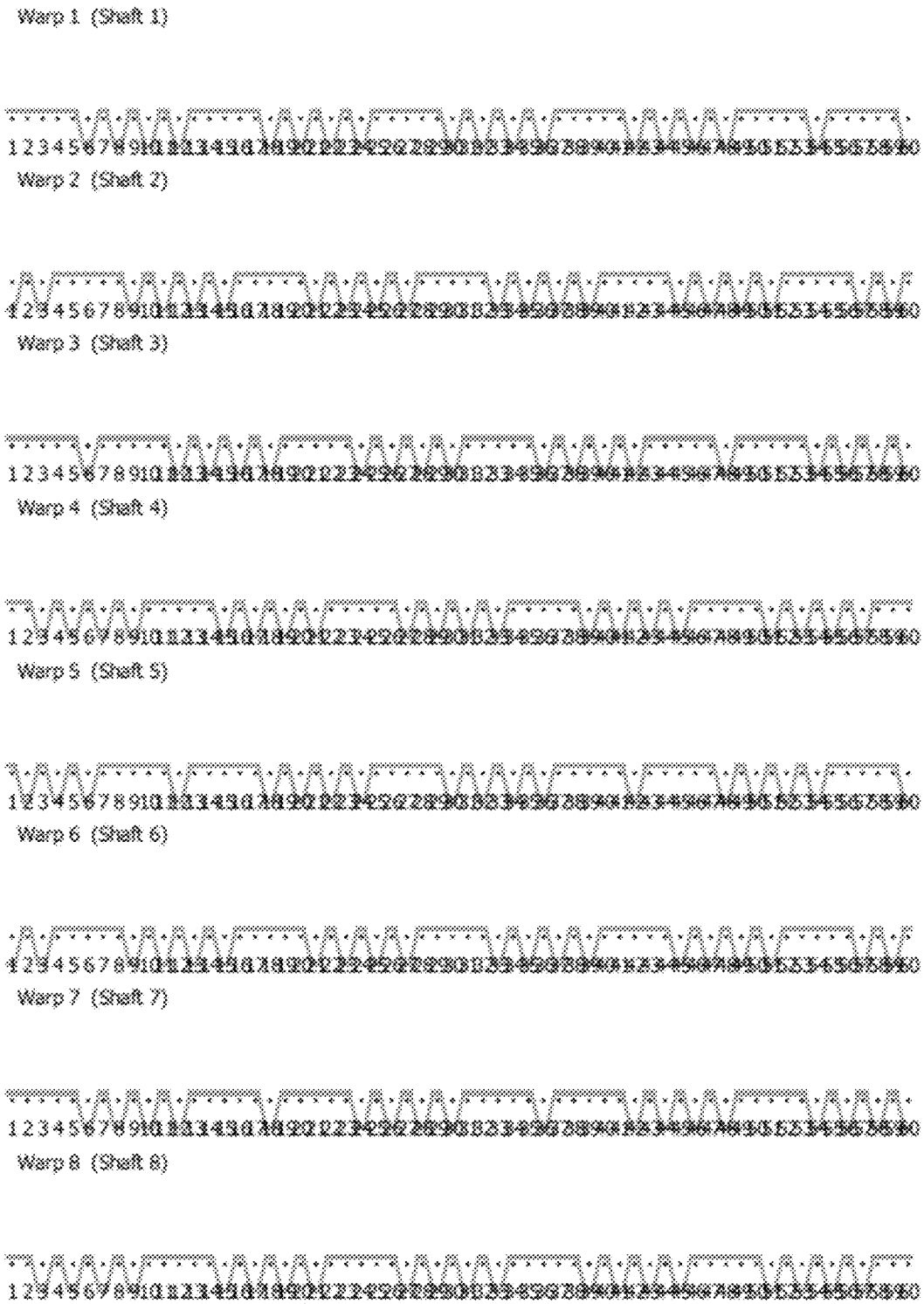
FIGS. 8A-8C show a warp yarn paths of the third embodiment.
Figure 8B:
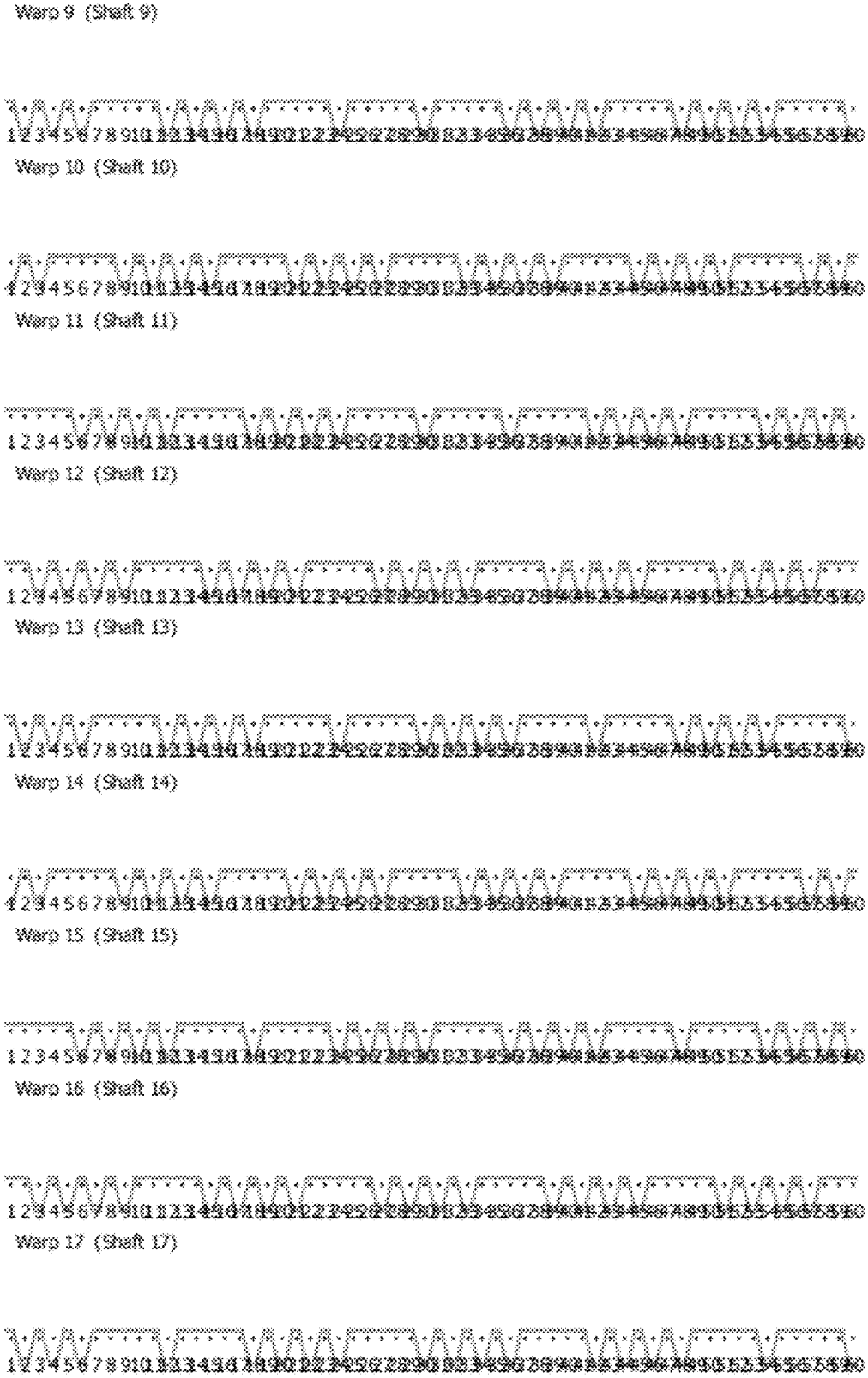
Figure 8C:
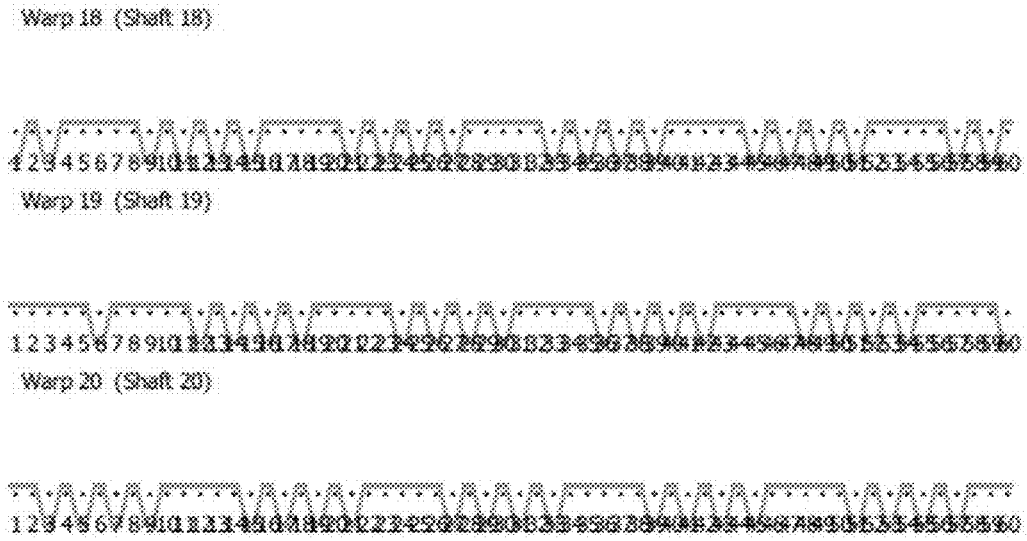

The third embodiment according to FIG. 4 is described in more detail with respect to FIGS. 6-8C, wherein FIG. 6 shows the weaving pattern of the third embodiment, FIG. 6A shows the weaving card of the third embodiment, FIGS. 7A-7F show the weft yarn paths of the third embodiment, and FIGS. 8A-8C show the warp yarn paths of the third embodiment.

Figure 5:
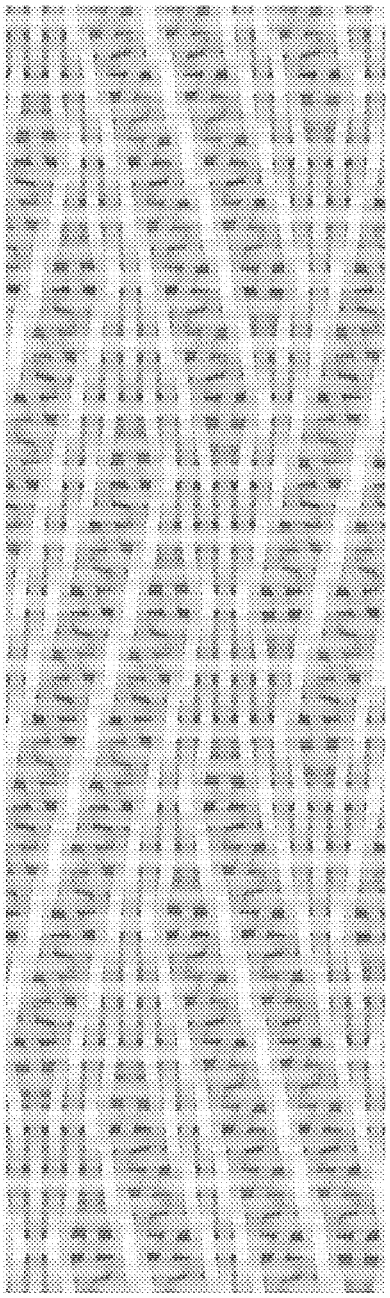
FIGS. 5 and 5A show a fourth embodiment of the woven fabric, similar to the third embodiment, and a modification of the fourth embodiment, respectively.
Figure 5A:
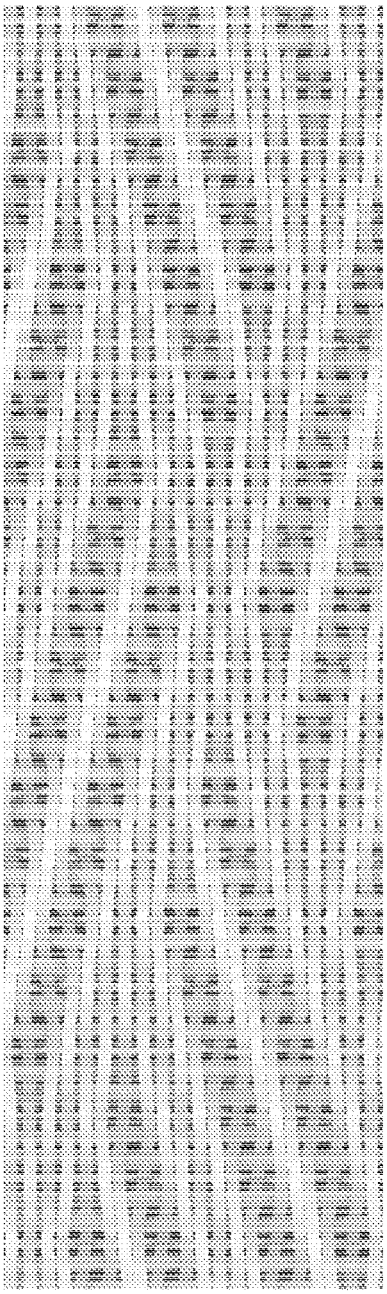

FIGS. 5 and 5A show a fourth embodiment of the present invention, similar to the third embodiment, and a modification of the second embodiment, respectively. In the following only the differences as to the third embodiment and its modification will be explained. For the rest, reference is made to the above description.

The fourth embodiment according to FIG. 5 and its modification according to FIG. 5A substantially only differ from the third embodiment according to FIG. 4 and its modification according to FIG. 4A, respectively, in that some first and second twill lines are broader then the remaining first and second twill lines. In fact, broad first and second twill lines alternate with small first and second twill lines, respectively.

All exemplary embodiments one to four with their respective modifications have in common that the flotations which form the diagonal twill lines each have a length of five. That means that the corresponding warp yarns pass over five consecutive weft yarns on the paper side of the woven fabric.

Furthermore, in all these embodiments one to four the weft yarns that pass under the middle of any of the flotations of the warp yarns on the paper side of the woven fabric are woven in a plain weave structure with the warp yarns of the woven fabric. Thus, each third weft yarn in these embodiments is woven in plain weave. In FIGS. 7A-7F referring to the third embodiment these weft yarns correspond to weft yarns 3, 6, 9 and so on. Moreover, these weft yarns can be easily identified in FIGS. 2A, 3A, 4A and 5A referring to the corresponding modifications, since these weft yarns have a smaller diameter than the remaining weft yarns that do not pass under the middle of any of the flotations of the warp yarns on the paper side of the woven fabric.

Even though using weft yarns with a smaller diameter results in that the warp yarn flotations on the paper side are not as high as using weft yarns with a larger diameter, there is still room for improvements. It is the merit of the inventor to have found out that a weft yarn being up on either side at the center of every warp yarn flotation creates a pressure point at the center of each flotation which restricts fabric life. The pointed nature of the warp yarn flotation also makes it difficult to surface sand the fabric to the desired level of contact area without removing excessive amounts of material of the warp yarns. In addition, the weft yarns with the plain weave structure can make it difficult to drive the count high enough to reduce fabric permeability to a reasonable level.

To further improve the above-described embodiments of the present invention, it is proposed to substitute each weft yarn that passes under the middle of a flotation on the paper side of the woven fabric by a pair of adjacent weft yarns that are not woven in a plain weave structure. To be more precise, it is preferred that one weft yarn of the pair of weft yarns passes over exactly one warp yarn that is adjacent the flotation on a first side (e.g. on the left hand side) of the flotation and passes below exactly two warp yarns that are adjacent the flotation on a second side (e.g. on the right hand side) of the flotation, while the other weft yarn of the pair of weft yarns passes over exactly one warp yarn that is adjacent the flotation on the second side (e.g. the right hand side) of the flotation and passes below exactly two warp yarns that are adjacent the flotation on the first side (e.g. the left hand side) of that flotation.

Figure 9:
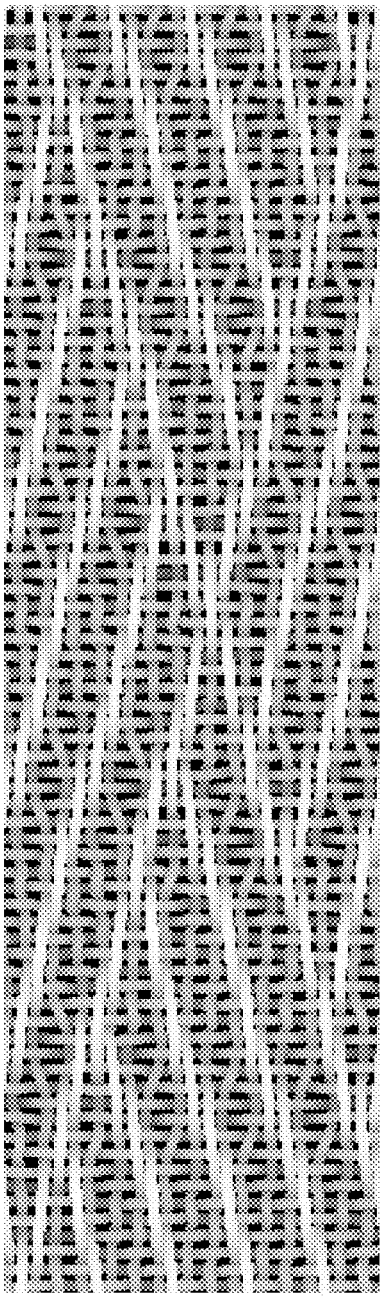
FIGS. 9 and 9A show a fifth embodiment of the woven fabric, similar to the third embodiment, and a modification of the fifth embodiment, respectively.
Figure 9A:
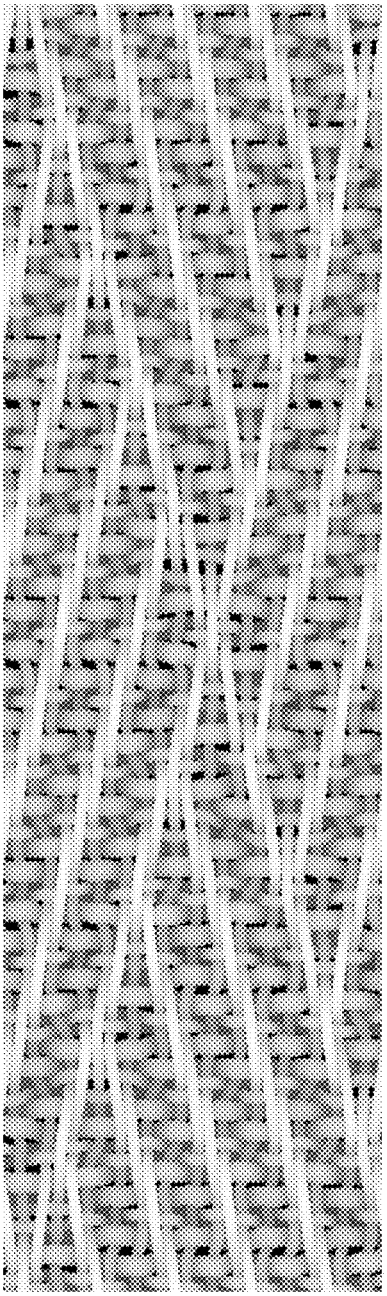

Modifying that way, the third embodiment shown in FIG. 4 and its corresponding modification shown in FIG. 4A results in the fifth embodiment shown in FIG. 9 and its corresponding modification shown in FIG. 9A, respectively. In the fifth embodiment and its modification each flotation of the warp yarns that form the diagonal twill lines has the length of seven, meaning that the corresponding warp yarns float over seven consecutive weft yarns on the paper side. Furthermore, each weft yarn from the pair of weft yarns passes over one warp yarn and then under three warp yarns instead of going up and down all the time as in the plain weave structure of the third embodiment. The result is that the woven fabric according to the fifth embodiment has the same number of weft knuckles compared to the third embodiment shown in FIG. 4 but the point at the center of the warp yarn flotation is flattened. The resulting fabric has much higher natural contact area so that les surface sanding is required to achieve the desired level of contact area. The pressure points are also eliminated. Furthermore, the elimination of the plain weave also allows the count to be woven higher which gives the advantage of lower air permeabilities that leads to better sheet drying.

Figure 10:
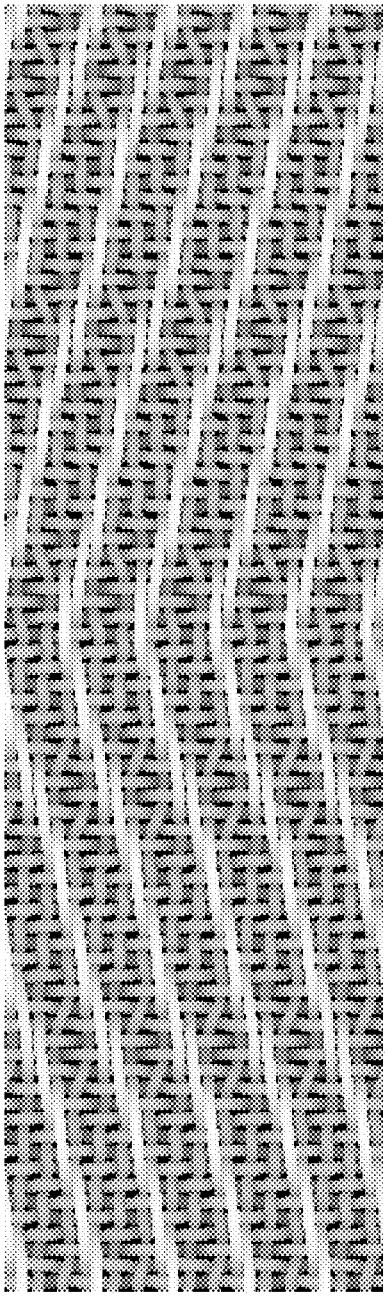
FIGS. 10 and 10A show a sixth embodiment of the woven fabric and a modification of the sixth embodiment, respectively.

A sixth embodiment of the present invention is shown in FIG. 10. Like in the fifth embodiment the warp yarn flotations forming the diagonal twill lines all have the length of seven. Furthermore, weft yarns that are situated in the middle of any one of the flotations that define the diagonal twill lines pass over exactly one adjacent warp yarn on a first side of the corresponding flotation and pass under exactly two adjacent warp yarns on a second side of the corresponding flotation, wherein the weft yarns that are situated in the middle of any one of the flotations that define the diagonal twill lines each have one adjacent other weft yarn which other weft yarn passes over exactly one adjacent warp yarn on the second side of the corresponding flotation and passes under exactly two adjacent warp yarns on the first side of the corresponding flotation. Thus, this embodiment substantially exhibits the same advantageous like the previously described fifth embodiment.

Figure 10A:
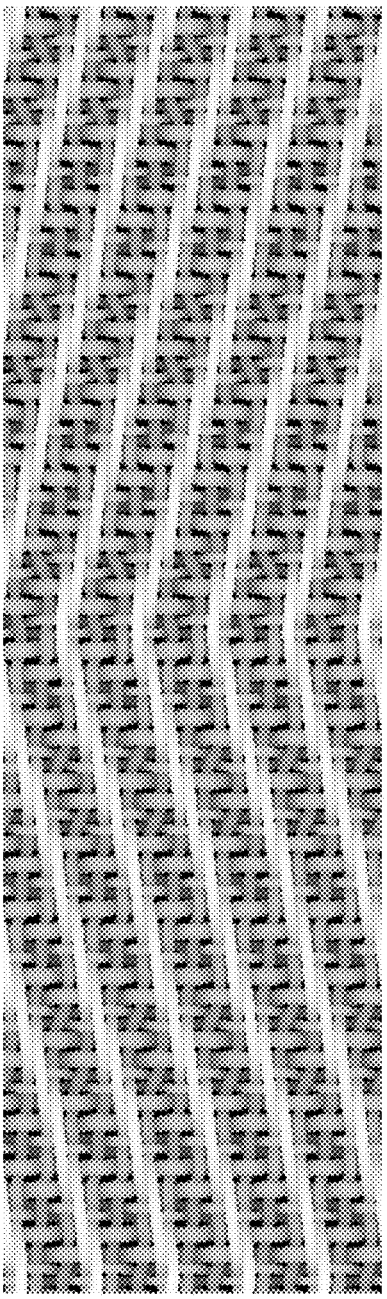

FIG. 10A shows a modification of the sixth embodiment from FIG. 10. The portion of a woven fabric in FIG. 10A has substantially the same weaving pattern as the weaving pattern of the portion of the woven fabric shown in FIG. 10. However, in FIG. 10A weft yarns with different diameter are applied. To be more precise, the weft yarns that are situated in the middle of any one of the flotations that define the diagonal twill lines and their corresponding adjacent other weft yarns have a smaller diameter than the remaining weft yarns that do not pass under the middle of any of the flotations of the warp yarns on the paper side of the woven fabric. This results in that the knuckles formed by the warp yarn flotations on the paper side are even less high compared in the sixth embodiment according to FIG. 10.

Finally, it should be noted that the modified embodiments shown in FIGS. 2*a*, 3*a*, 4*a*, 5*a*, 9*a* and 10*a* may additionally or alternatively differ from their corresponding basic embodiments according to FIGS. 2, 3, 4, 5, 9 and 10, respectively, in that some weft yarns are made from another material and/or are of a different type than other weft yarns.

The following is a summary list of reference numerals and the corresponding structure used in the above description of the invention:

10 woven fabric
10' woven fabric (prior art)
CD cross machine direction
CD-VC1 first CD vector component
CD-VC2 second CD vector component
CD-VC' CD vector component (prior art)
FL1-FL3 flotations
FL' flotation (prior art)
MD machine direction
MD-VC1 first MD vector component
MD-VC2 second MD vector component
MD-VC' MD vector component (prior art)
TL1 first diagonal twill line
TL2 second diagonal twill line
TL' twill line (prior art)
WA1-WA3 warp yarns
WA1'-WA3' warp yarns (prior art)
WE1-WE5 weft yarns
WE1'-WE5' weft yarns (prior art)

The invention claimed is:

1. A woven fabric for use in a machine to produce a fiber web, the woven fabric comprising:

a machine direction;

a cross machine direction;

a machine side;

a paper side formed from warp yarns and weft yarns, said warp yarns and said weft yarns are interwoven with each other, said paper side having a plurality of twill lines, each twill line of said twill lines being formed by a plurality of neighboring flotations of said warp yarns, wherein said twill lines having an MD vector component directed in said machine direction of the woven fabric and a CD vector component directed in said cross machine direction of the woven fabric, wherein at least some of said twill lines are diagonal twill lines meaning that the CD vector component of said twill lines is unequal to zero, wherein said weft yarns that are situated in a middle of any one of said flotations that define said diagonal twill lines pass over at least one adjacent one of said warp yarns on a first side of a corresponding one of said flotations and pass under at least one adjacent one of said warp yarns on a second side of said corresponding flotation;

a plurality of said diagonal twill lines including first diagonal twill lines and second diagonal twill lines, wherein CD vector components of the first diagonal twill lines have an opposite sign to CD vector components of the second diagonal twill lines; and a sum of all the CD vector components of the first diagonal twill lines is substantially balanced with a sum of all the CD vector components of the second diagonal twill lines.

2. The woven fabric according to claim 1, wherein a number of said first diagonal twill lines substantially equals a number of said second diagonal twill lines.

3. The woven fabric according to claim 1, wherein a total length of all said first diagonal twill lines substantially equals a total length of all said second diagonal twill lines.

4. The woven fabric according to claim 1, wherein said first diagonal twill lines all have a same first CD vector component and said second diagonal twill lines all have a same second CD vector component.

5. The woven fabric according to claim 4, wherein the first CD vector component has a same absolute value as the second CD vector component.

6. The woven fabric according to claim 1, wherein all said diagonal twill lines have a same said MD vector component.

7. The woven fabric according to claim 1, wherein said diagonal twill lines are formed from said neighboring flotations of said warp yarns, wherein said flotations have a length of at least 3.

8. The woven fabric according to claim 1, wherein said diagonal twill lines are formed from neighboring flotations of said warp yarns, wherein said flotations have a length of 5.

9. The woven fabric according to claim 1, wherein some of said weft yarns differ from other said weft yarns in at least one of the following features: cross section, material, and type.

10. The woven fabric according to claim 9, wherein said weft yarns that are situated in a middle of any one of said flotations that define said diagonal twill lines have a cross section which is smaller than cross sections of remaining said weft yarns that are not situated in said middle of any one of said flotations that define said diagonal twill lines.

11. The woven fabric according to claim 1, wherein said warp yarns which form said flotations of said diagonal twill lines are interwoven with said weft yarns in a plain weave structure between two successive ones of said flotations.

12. The woven fabric according to claim 1, wherein said flotations of said warp yarns which define said diagonal twill lines themselves form an angle unequal to 0° with said machine direction of the woven fabric, wherein a sign of an angle corresponds to a sign of the MD vector component of a diagonal twill line of said diagonal twill lines that is formed by a corresponding flotation of said flotations.

13. The woven fabric according to claim 1, wherein at least some of said diagonal twill lines extend straight from one side of the woven fabric to an opposite side thereof.

14. The woven fabric according to claim 1, wherein at least some of said diagonal twill lines end somewhere between opposite sides of the woven fabric.

15. The woven fabric according to claim 1, wherein some of said diagonal twill lines are broader than other said diagonal twill lines.

16. The woven fabric according to claim 1, wherein said diagonal twill lines are formed from said neighboring flotations of said warp yarns, wherein said flotations have a length of 7.

17. The woven fabric according to claim 1, wherein said weft yarns that are situated in said middle of any one of said flotations that define said diagonal twill lines, each have one adjacent other weft yarn of said weft yarns which said adjacent other weft yarn passes over at least one adjacent one of said warp yarns on said second side of said corresponding flotation and passes under at least one adjacent one of said warp yarns on said first side of said corresponding flotation.

18. The woven fabric according to claim 1, wherein said weft yarns that are situated in said middle of any one of said flotations that define said diagonal twill lines pass over exactly one adjacent one of said warp yarns on said first side of a corresponding one of said flotations and pass under exactly two adjacent ones of said warp yarns on said second side of said corresponding flotation.

19. The woven fabric according to claim 18, wherein said weft yarns that are situated in said middle of any one of said flotations that define said diagonal twill lines each have one adjacent other weft yarn which said adjacent other weft yarn passes over exactly one adjacent warp yarn on said second side of said corresponding flotation and passes under exactly two adjacent warp yarns on said first side of said corresponding flotation.

20. The woven fabric according to claim 17, wherein said weft yarns that are situated in said middle of any one of said flotations that define said diagonal twill lines and their corresponding adjacent other weft yarns are equal to each other in view of at least one the following features: cross section, material, and type, but differ from other said weft yarns in the woven fabric in view of that feature.

* * * * *